US009665118B2

(12) United States Patent
Kim

(10) Patent No.: US 9,665,118 B2
(45) Date of Patent: May 30, 2017

(54) SEMICONDUCTOR APPARATUS AND SEMICONDUCTOR SYSTEM

(71) Applicant: SK hynix Inc., Icheon-si, Gyeonggi-do (KR)

(72) Inventor: Sang Hwan Kim, Icheon-si (KR)

(73) Assignee: SK hynix Inc., Icheon-si (KR)

( * ) Notice: Subject to any disclaimer, the term of this patent is extended or adjusted under 35 U.S.C. 154(b) by 0 days.

(21) Appl. No.: 15/045,494

(22) Filed: Feb. 17, 2016

(65) Prior Publication Data

US 2017/0060168 A1 Mar. 2, 2017

(30) Foreign Application Priority Data

Aug. 31, 2015 (KR) ..... 10-2015-0122969

(51) Int. Cl.
*G05F 5/00* (2006.01)

(52) U.S. Cl.
CPC ..... *G05F 5/00* (2013.01)

(58) Field of Classification Search
CPC ..... G05F 5/00
See application file for complete search history.

(56) References Cited

U.S. PATENT DOCUMENTS 5,265,063 A * 11/1993 Kogure ..... G11C 7/00 327/261
7,997,500 B2 * 8/2011 Hayashi ..... G06F 21/73 235/492

FOREIGN PATENT DOCUMENTS

KR 1019990028475 A 4/1999

* cited by examiner

*Primary Examiner* — Jeffrey Zweizig
(74) *Attorney, Agent, or Firm* — William Park & Associates Ltd.

(57) ABSTRACT

A semiconductor apparatus includes a controller configured to generate a plurality of control signals for selecting an operation mode of the semiconductor apparatus in response to a number of input chip enable pulses, and an output driving unit configured to be operated according to the operation mode of the semiconductor apparatus based on the plurality of control signals.

18 Claims, 6 Drawing Sheets

SEMICONDUCTOR APPARATUS AND SEMICONDUCTOR SYSTEM

CROSS-REFERENCES TO RELATED APPLICATION

This application claims priority under 35 U.S.C. 119(a) to Korean application No. 10-2015-0122969, filed on Aug. 31, 2015, in the Korean Intellectual Property Office, which is incorporated herein by reference in its entirety as set forth in full.

BACKGROUND

1. Technical Field

The inventive concept relates to a semiconductor integrated circuit, and more particularly, to a semiconductor apparatus and a semiconductor system.

2. Related Art

Semiconductor apparatuses may be configured to perform an operation by receiving signals and outputting an operation result as an output signal.

The signals input to the semiconductor apparatus may include a control signal for controlling an operation of the semiconductor apparatus, data input according to an operation of the semiconductor apparatus, and the like.

The signals output from the semiconductor apparatus may include a result of an operation of the semiconductor apparatus as an output signal. The output signal may include data.

SUMMARY

According to an embodiment, there is provided a semiconductor apparatus. The semiconductor apparatus may include a controller configured to generate a plurality of control signals for selecting an operation mode of the semiconductor apparatus in response to a number of input chip enable pulses; and an output driving unit configured to operate according to the operation mode of the semiconductor apparatus based on the plurality of control signals.

According to an embodiment, there is provided a semiconductor system. The semiconductor system may include a controller configured to provide a first chip enable pulse and a second chip enable pulse; a first chip configured to select an operation mode thereof in response to a number of input first chip enable pulses; and a second chip configured to select an operation mode thereof in response to a number of input second chip enable pulses. An output node of the first chip and an output node of the second chip, to which output is data, may be commonly coupled.

According to an embodiment, there is provided a semiconductor system. The semiconductor system may include a first chip configured with respect to a first chip enable signal and a first driving voltage control signal, and the first chip includes a first output driving unit; a second chip configured with respect to a second chip enable signal and a second driving voltage control signal, and the second chip includes a second output driving unit; an interface including a first controller configured to generate the first chip enable signal and the first driving voltage control signal in response to a number of input first chip enable pulses and the interface includes a second controller configured to generate the second chip enable signal and the second driving voltage control signal in response to a number of input second chip enable pulses; and a controller configured to provide the first and second chip enable pulses.

BRIEF DESCRIPTION OF THE DRAWINGS

The above and other aspects, features and other advantages of the subject matter of the present disclosure will be more clearly understood from the following detailed description taken in conjunction with the accompanying drawings, in which.

DETAILED DESCRIPTION

Figure 1:
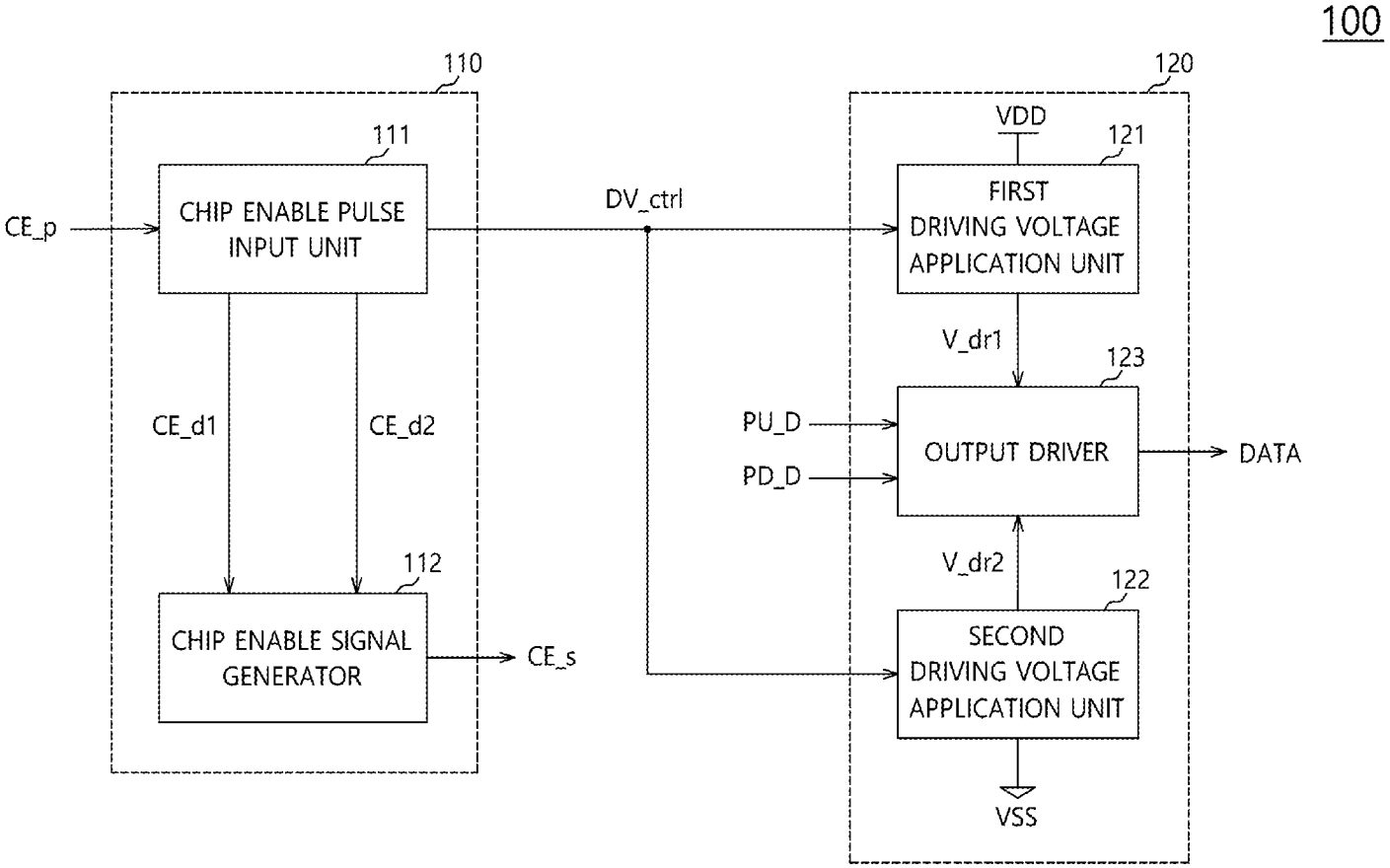
FIG. 1 is a configuration diagram illustrating a semiconductor apparatus according to an embodiment of the inventive concept.

These and other features, aspects, and embodiments are described below in the section detailed description.

Hereinafter, example embodiments will be described in greater detail with reference to the accompanying drawings. Example embodiments are described herein with reference to cross-sectional illustrations that are schematic illustrations of the example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but may include deviations in shapes that result, for example, from manufacturing. In the drawings, lengths and sizes of layers and regions may be exaggerated for clarity. Like reference numerals in the drawings denote like elements. It is also understood that when a layer is referred to as being "on" another layer or substrate, the layer can be directly on the other or substrate, or intervening layers may also be present.

The inventive concept is described herein with reference to cross-section and/or plan illustrations that are schematic illustrations of idealized embodiments of the inventive concept. However, embodiments of the inventive concept should not be limited or construed as limited to the inventive concept. Although a few embodiments of the inventive concept will be shown and described, it will be appreciated by those of ordinary skill in the art that changes may be made in these example embodiments without departing from the principles and spirit of the inventive concept.

As illustrated in FIG. 1, a semiconductor apparatus 100 according to an embodiment may include a controller 110 and an output driving unit 120. As used herein a unit may also be referred to as a circuit. Thus, any reference to a unit can be replaced by a reference to a circuit. Accordingly, the output driving unit 120 may be referred to as an output driving circuit 120. This applies to any unit described herein.

The controller 110 may generate a driving voltage control signal DV_ctrl and a chip enable signal CE_s in response to a chip enable pulse CE_p. The controller 110 may generate a plurality of control signals, for example, the driving voltage control signal DV_ctrl and the chip enable signal CE_s capable of selecting an operation mode of the semiconductor apparatus 100 in response to the number of input chip enable pulses CE_p. For example, when the chip enable pulse CE_p is input a first time to the controller 110, that is, when the chip enable pulse CE_p is input once, the controller 110 may enable the chip enable signal CE_s in a state in which the driving voltage control signal DV_ctrl is disabled. When the chip enable pulse CE_p is input a second time to the controller 110, that is, when the chip enable pulse CE_p is input twice, the controller 110 may enable the driving voltage control signal DV_ctrl when the chip enable signal CE_s is enabled. When the chip enable pulse CE_p is input a third time to the controller 110, that is, when the chip enable pulse CE_p is input three times, the controller 110 may disable the chip enable signal CE_s and the driving voltage control signal DV_ctrl.

The controller 110 may include a chip enable pulse input unit 111 and a chip enable signal generator 112.

The chip enable pulse input unit 111 may generate the driving voltage control signal DV_ctrl, a first chip enable determination signal CE_d1, and a second chip enable determination signal CE_d2 in response to a number of input chip enable pulses CE_p. For example, whenever the chip enable pulse CE_p is input, the chip enable pulse input unit 111 may sequentially enable the driving voltage control signal DV_ctrl, the first chip enable determination signal CE_d1, and the second chip enable determination signal CE_d2 one by one. In this example, when the chip enable pulse CE_p is input a first time, the chip enable pulse input unit 111 may enable the second chip enable determination signal CE_d2. When the chip enable pulse CE_p is input a second time, the chip enable pulse input unit 111 may disable the second chip enable determination signal CE_d2 and enable the driving voltage control signal DV_ctrl. When the chip enable pulse CE_p is a third time, the chip enable pulse input unit 111 may disable the driving voltage control signal DV_ctrl and enable the first chip enable determination signal CE_d1. When the chip enable pulse CE_p is input a fourth time, the chip enable pulse input unit 111 may disable the first chip enable determination signal CE_d1 and enable the second chip enable determination signal CE_d2 again. That is, whenever the chip enable pulse CE_p is input, the chip enable pulse input unit 111 may sequentially enable only one of the driving voltage control signal DV_ctrl, the first chip enable determination signal CE_d1, and the second chip enable determination signal CE_d2 in the order of the second chip enable determination signal CE_d2, the driving voltage control signal DV_ctrl, and the first chip enable determination signal CE_d1.

The chip enable signal generator 112 may generate the chip enable signal CE_s in response to the first and second chip enable determination signals CE_d1 and CE_d2. When the first chip enable determination signal CE_d1 is enabled and the second chip enable determination signal CE_d2 is disabled, the chip enable signal generator 112 may disable the chip enable signal CE_s. The chip enable signal generator 112 may enable the chip enable signal CE_s in the remaining period other than a period in which the first chip enable determination signal CE_d1 is enabled and the second chip enable determination signal CE_d2 is disabled.

The output driving unit 120 may output data DATA outside of the semiconductor apparatus 100 in response to the driving voltage control signal DV_ctrl, pull up data PU_D and pull down data PD_D. For example, when the driving voltage control signal DV_ctrl is disabled, the semiconductor apparatus 100 may be enabled, the output driving unit 120 may be activated or active and may output the data DATA in response to the pull up data PU_D and the pull down data PD_D. When the driving voltage control signal DV_ctrl is enabled, the output driving unit 120 may be deactivated and may not output the data DATA. The output driving unit 120 may be operated in a mode in which the semiconductor apparatus 100 is deactivated.

The output driving unit 120 may include first and second driving voltage application units 121 and 122, and an output driver 123.

The first driving voltage application unit 121 may provide a first driving voltage V_dr1 to the output driver 123 in response to the driving voltage control signal DV_ctrl. When the driving voltage control signal DV_ctrl is disabled, the first driving voltage application unit 121 may provide the first driving voltage V_dr1 to the output driver 123. When the driving voltage control signal DV_ctrl is enabled, the first driving voltage application unit 121 may stop providing the first driving voltage V_dr1 to the output driver 123. For example, when the driving voltage control signal DV_ctrl is disabled, the first driving voltage application unit 121 may provide an external voltage VDD as the first driving voltage V_dr1 to the output driver 123.

The second driving voltage application unit 122 may provide a second driving voltage V_dr2 to the output driver 123 in response to the driving voltage control signal DV_ctrl. When the driving voltage control signal DV_ctrl is disabled, the second driving voltage application unit 122 may provide the second driving voltage V_dr2 to the output driver 123. When the driving voltage control signal DV_ctrl is enabled, the second driving voltage application unit 122 may stop providing the second driving voltage V_dr2 to the output driver 123. For example, when the driving voltage control signal DV_ctrl is disabled, the second driving voltage application unit 122 may provide a ground voltage VSS as the second driving voltage V_dr2 to the output driver 123.

When the first and second driving voltages V_dr1 and V_dr2 are received, the output driver 123 may be activated. The activated output driver 123 may output the data DATA in response to the pull up data PU_D and the pull down data PD_D by receiving the first and second driving voltages V_dr1 and V_dr2. The output driver 123 may be deactivated when the first and second driving voltages V_dr1 and V_dr2 are not received.

Figure 2:
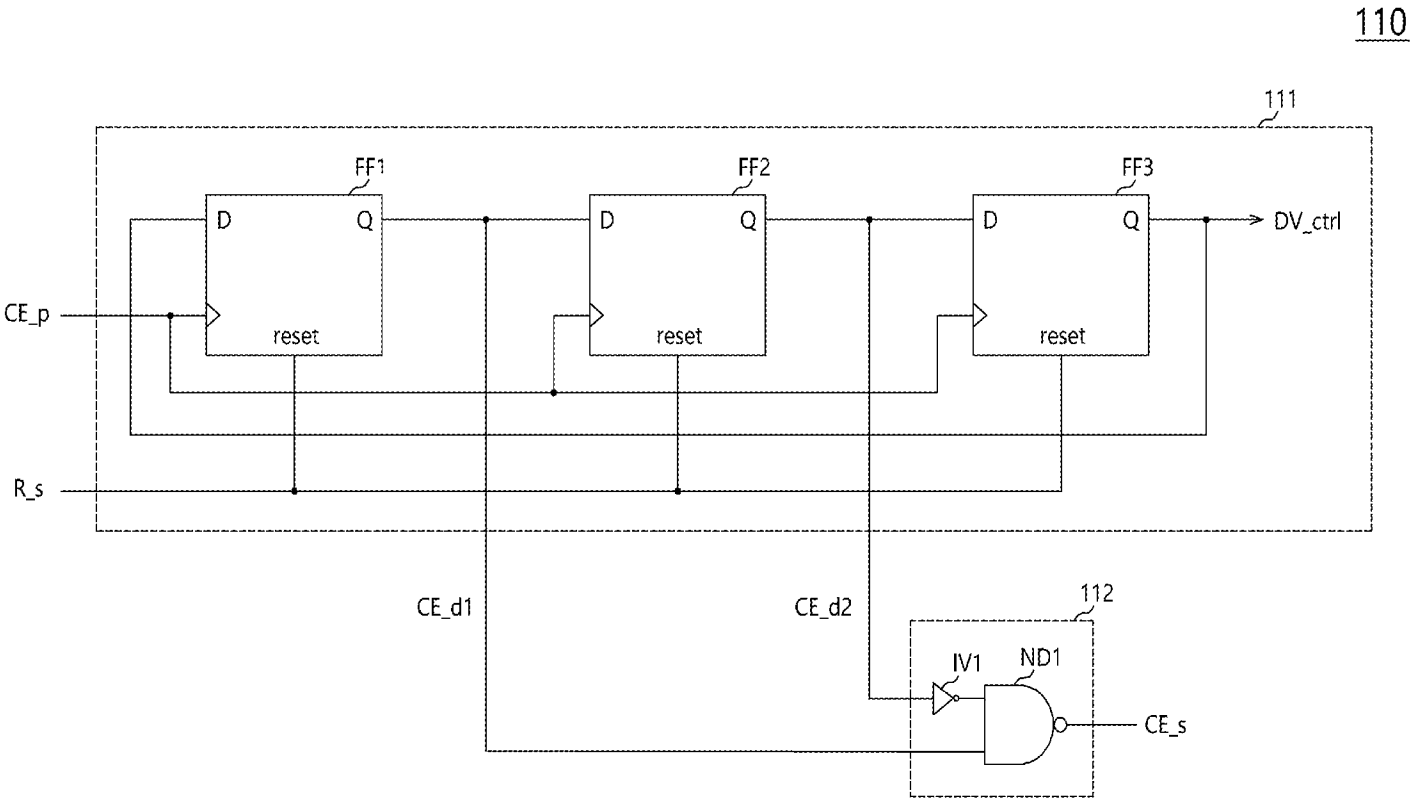
FIG. 2 is a configuration diagram illustrating a controller of FIG. 1.

As illustrated in FIG. 2, the controller 110 may include the chip enable pulse input unit 111 and the chip enable signal generator 112.

The chip enable pulse input unit 111 may include first to third flip flops FF1, FF2, and FF3. The first flip flop FF1 may receive the driving voltage control signal DV_ctrl through an input terminal, receive the chip enable pulse CE_p through a clock input terminal, and receive a reset signal R_s through a reset terminal. The second flip flop FF2 may receive a signal output from an output terminal of the first flip flop FF1 through an input terminal, receive the chip enable pulse CE_p through a clock input terminal, and receive the reset signal R_s through a reset terminal. The third flip flop FF3 may receive a signal output from an output terminal of the second flip flop FF2 through an input terminal, receive the chip enable pulse CE_p through a clock input terminal, and receive the reset signal R_s through a reset terminal. The output signal of the first flip flop FF1 may be the first chip enable determination signal CE_d1, the output signal of the second flip flop FF2 may be the second chip enable determination signal DE_d2, and an output signal of the third flip flop FF3 may be the driving voltage control signal DV_ctrl. When the reset signal R_s is enabled, the output signal of the first flip flop FF1 (that is, the first chip enable determination signal CE_d1) may be initialized to a high level, the output signal of the second flip flop FF2 (that is, the second chip enable determination signal CE_d2) may be initialized to a low level, and the output signal of the flip flop FF3 (that is, the driving voltage control signal DV_ctrl) may be initialized to the low level.

The chip enable signal generator 112 may generate the chip enable signal CE_s in response to the first and second chip enable determination signals CE_d1 and CE_d2. For example, the chip enable signal generator 112 may disable the chip enable signal CE_s in a period in which the first chip enable determination signal CE_d1 is enabled and the second chip enable determination signal CE_d2 is disabled. The chip enable signal generator 112 may enable the chip enable signal CE_s in the remaining period other than the period in which the first chip enable determination signal CE_d1 is enabled and the second chip enable determination signal CE_d2 is disabled.

The chip enable signal generator 112 may include a first inverter IV1 and a NAND gate ND1. The first inverter IV1 may receive the second chip enable determination signal CE_d2. The NAND gate ND1 may output the chip enable signal CE_s based on the received first chip enable determination signal CE_d1 and an output signal of the first inverter IV1.

An operation of the semiconductor apparatus having the above-described configuration according to an embodiment will be described below.

Figure 3:
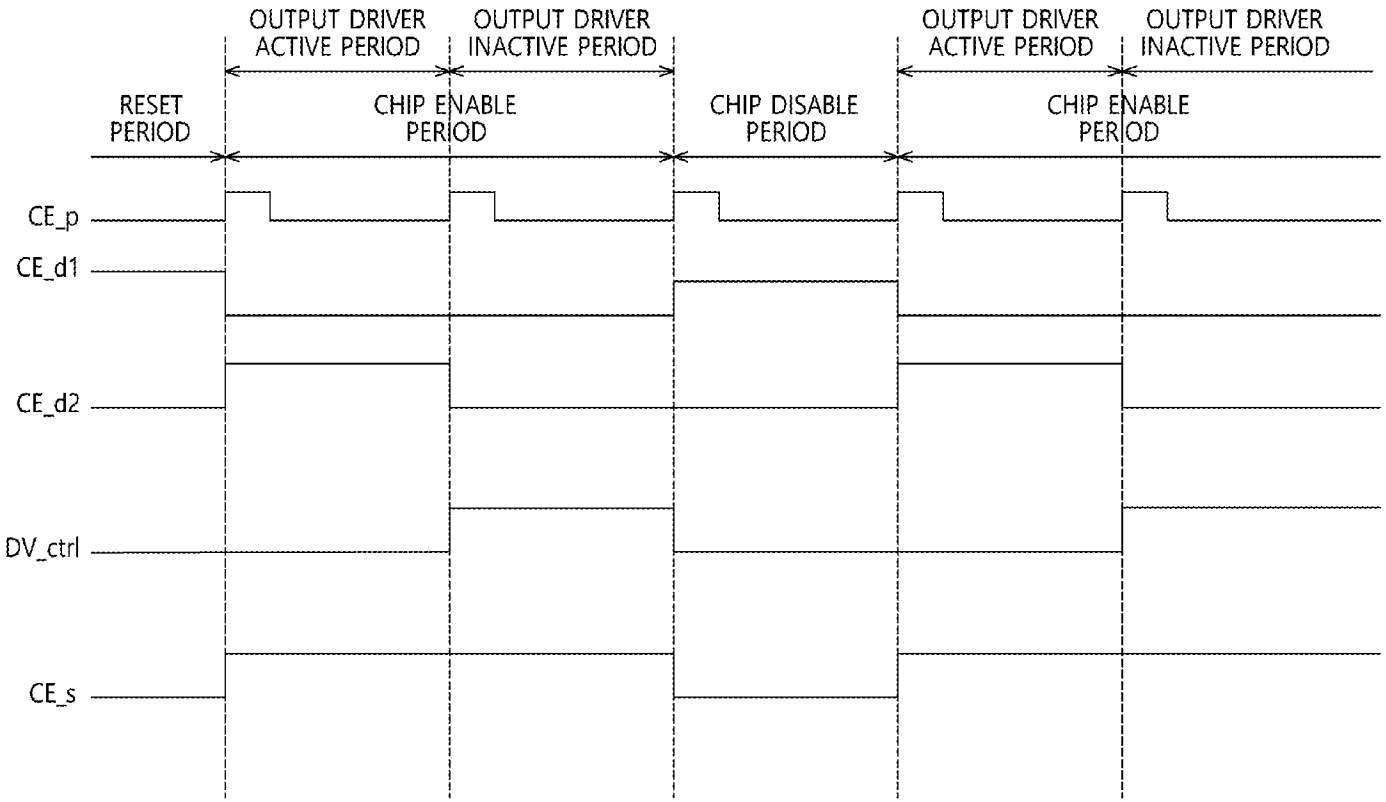
FIG. 3 is a timing diagram explaining an operation of a semiconductor apparatus according to an embodiment of the inventive concept.

Referring to FIGS. 2 and 3, when the reset signal R_s is enabled, the first chip enable determination signal CE_d1 may be initialized to the high level, the second chip enable determination signal CE_d2 may be initialized to the low level, and the driving voltage control signal DV_ctrl may be initialized to the low level.

After the reset period marked by the reset signal R_s, the chip enable pulse CE_p is input first.

Whenever the chip enable pulse CE_p is input, that is, whenever the chip enable pulse CE_p is transited to the high level, the first to third flip flops FF1 to FF3 may output signals input to the input terminals of the first to third flip flops FF1 to FF3 as the output signals output through the output terminals of the first to third flip flops FF1 to FF3.

When the chip enable pulse CE_p is input the first time, the first chip enable determination signal CE_d1 may be disabled to the low level, the second chip enable determination signal CE_d2 may be enabled to the high level, and the driving voltage control signal DV_ctrl may be maintained in a state disabled to the low level.

When the chip enable pulse CE_p is input the second time, the first chip enable determination signal CE_d1 may be maintained in the disabled state, the second chip enable determination signal CE_d2 may be disabled to the low level, and the driving voltage control signal DV_ctrl may be enabled to the high level.

When the chip enable pulse CE_p is input the third time, the first chip enable determination signal CE_d1 may be enabled to the high level, the second chip enable determination signal CE_d2 may be maintained in the disabled state, and the driving voltage control signal DV_ctrl may be disabled to the low level.

When the chip enable pulse CE_p is input the fourth time, the first chip enable determination signal CE_d1 may be disabled to the low level, the second chip enable determination signal CE_d2 may be enabled to the high level, and the driving voltage control signal DV_ctrl may be maintained in the disabled state.

When the chip enable pulse CE_p is input the fifth time, the first chip enable determination signal CE_d1 may be maintained in the disabled state, the second chip enable determination signal CE_d2 may be disabled to the low level, and the driving voltage control signal DV_ctrl may be enabled to the high level.

Whenever the chip enable pulse CE_p is input, the chip enable pulse input unit 111 illustrated in FIGS. 1 and 2 may sequentially enable one of the first and second chip enable determination signals CE_d1 and CE_d2 and the driving voltage control signal DV_ctrl.

The chip enable signal generator 112 may determine whether or not to enable the chip enable signal CE_s in response to the first and second chip enable determination signals CE_d1 and CE_d2. The chip enable signal generator 112 may disable the chip enable signal CE_s in the period the first chip enable determination signal CE_d1 is enabled and the second chip enable determination signal CE_d2 is disabled. That is, the chip enable signal generator 112 may enable the chip enable signal CE_s in the remaining period other than the period in which the first chip enable determination signal CE_d1 is enabled and the second chip enable determination signal CE_d2 is disabled. Accordingly, the chip enable signal generator 112 may disable the chip enable signal CE_s in the period the first chip enable determination signal CE_d1 is enabled, that is, whenever the chip enable pulse is input for the third time, and enable the chip enable signal CE_s whenever the chip enable pulse CE_p is input for the fourth time.

The semiconductor apparatus 100 according to an embodiment may enable the second chip enable determination signal CE_d2 a first time when the chip enable pulse CE_p is first input, may enable the driving voltage control signal DV_ctrl a second time when the chip enable pulse CE_p is input a second time, and may enable the first chip enable determination signal CE_d1 a third time when the chip enable pulse CE_p is input a third time. The semiconductor apparatus 100 according to an embodiment may disable the chip enable signal CE_s when the first chip enable determination signal CE_d1 is enabled and the second chip enable determination signal CE_d2 is disabled. That is, the semiconductor apparatus 100 according to an embodiment may enable the chip enable signal CE_s in the remaining period other than the period in which the first chip enable determination signal CE_d1 is enabled and the second chip enable determination signal CE_d2 is disabled.

The output driving unit 120 illustrated in FIG. 1 may be activated upon generating the first and second driving voltages V_dr1 and V_dr2 when the driving voltage control signal DV_ctrl is disabled, and output the data DATA in response to the pull up data PU_D and the pull down data PD_D in the activated state. The output driving unit 120 may be deactivated when the driving voltage control signal DV_ctrl is enabled and thus the generation of the first and second driving voltage V_dr1 and V_dr2 is interrupted.

As described above, the output driving unit 120 may include the first and second driving voltage application units 121 and 122 and the output driver 123. The first and second driving voltage application units 121 and 122 may possibly not provide the first and second driving voltages V_dr1 and V_dr2 to the output driver 123 when the driving voltage control signal DV_ctrl is enabled, and the first and second driving voltage application units 121 and 122 may provide the first and second driving voltages V_dr1 and V_dr2 to the output driver 123 when the driving voltage control signal DV_ctrl is disabled.

An operation of the semiconductor apparatus 100 according to an embodiment will be described with reference to FIG. 3.

When the chip enable pulse CE_p is input a first time, the chip enable signal CE_s may be enabled and the output driver 123 may be activated in the chip enable period.

When the chip enable pulse CE_p is input a second time, the output driver 123 may be deactivated in the period in which the chip enable signal CE_s is enabled.

When the chip enable pulse CE_p is input a third time, the chip enabled signal CE_s may be disabled.

That is, the semiconductor apparatus 100 according to an embodiment may be activated when the chip enable pulse CE_p is first input. The semiconductor apparatus 100 may deactivate the output driver 123 from the activated state when the chip enable pulse CE_p is input the second time. The semiconductor apparatus 100 may be deactivated when the chip enable pulse CE_p is input a third time.

According to the number of input chip enable pulses CE_p, the semiconductor apparatus 100 according to an embodiment may be activated or deactivated, or may activate or deactivate the output driver. That is, the semiconductor apparatus 100 according to an embodiment may select an operation mode thereof according to a number of input chip enable pulses CE_p. For example, the semiconductor apparatus 100 may select the operation mode thereof among a chip active mode, an output driver inactive mode in the chip active state, and a chip inactive mode, and the chip active mode may be selectively operated according to the selected mode.

Accordingly, the semiconductor apparatus 100 may selectively operate in three or more modes according to the number of input chip enable pulses.

Figure 4:
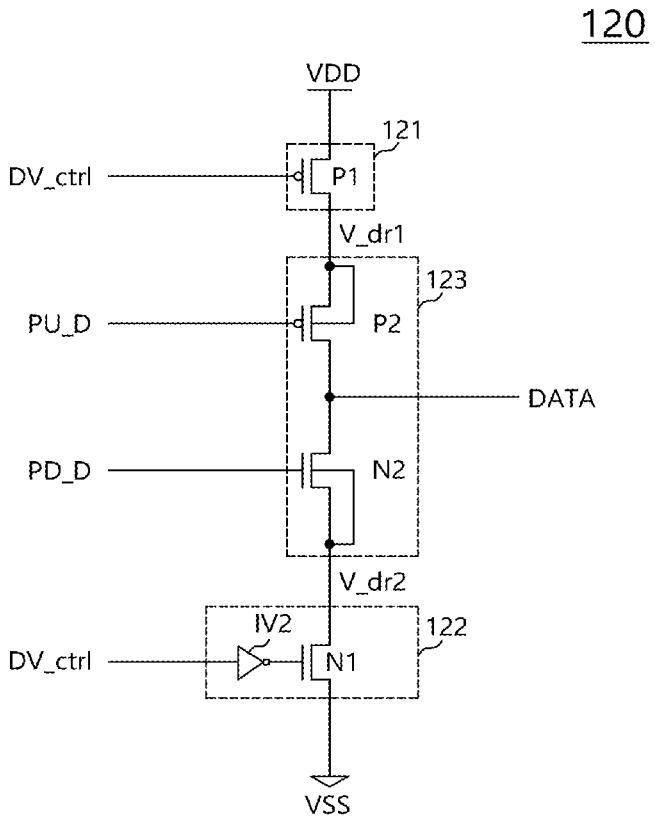
FIG. 4 is a configuration diagram illustrating an output driving unit of FIG. 1.

The output driving unit 120 of FIG. 1 may have the configuration illustrated in FIG. 4.

The first driving voltage application unit 121 may include a first transistor P1. The first transistor P1 may receive the driving voltage control signal DV_ctrl through a gate, receive the external voltage VDD through a source, and output the first driving voltage V_dr1 through a drain.

The second driving voltage application unit 122 may include a second transistor N1 and a second inverter IV2. The second inverter IV2 may receive the driving voltage control signal DV_ctrl. The second transistor N1 may receive an output signal of the second inverter IV2 through a gate, receive the ground voltage VSS through a source, and output the second driving voltage V_dr2 through a drain.

The output driver 123 may include third and fourth transistors P2 and N2. The third transistor P2 may receive the pull up data PU_D through a gate, and receive the first driving voltage V_dr1 through a source and a back bias terminal. The fourth transistor N2 may receive the pull down data PD_D through a gate, and receive the second driving signal V_dr2 through a source and a back bias terminal. The third and fourth transistors P2 and N2 may output the data DATA through a node in which drains of the third and fourth transistors are coupled.

In the output driving unit 120 having the above-described configuration according to an embodiment, the first and second driving voltages V_dr1 and V_dr2 may or may not be provided to the output driver 123 according to the driving voltage control signal DV_ctrl. When the first and second driving voltages V_dr1 and V_dr2 are provided to the output driver 123, the output driver 123 may be activated and generate the data DATA in response to the pull up data PU_D and the pull down data PD_D. When the first and second driving voltages V_dr1 and V_dr2 are not provided to the output driver 123, the output driver 123 may be deactivated. That is, when the first and second driving voltages V_dr1 and V_dr2 are provided to the output driver 123, the output driver 123 may generate the data DATA in response to the pull up data PU_D and the pull down data PD_D. When the first and second driving voltages V_dr1 and V_dr2 are not provided to the output driver 123, the output driver 123 may possibly not generate the data.

When the output driver 123 is deactivated providing of the first and second driving voltages V_dr1 and V_dr2 to the sources and the back bias terminals of the third and fourth transistors P2 and N2 may be interrupted. When providing of the first and second driving voltages V_dr1 and V_dr2 to the sources and the back bias terminals of the third and fourth transistors P2 and N2 is interrupted, the junction capacitances of the third and fourth transistors P2 and N2 may be removed, thus the parasitic capacitance of a line or a node to which the data DATA is output may be reduced. Accordingly, loading of the line to which the data DATA is output may be reduced.

The semiconductor apparatus 100 according to an embodiment may select the operation mode thereof according to the number of input chip enable pulses CE_p. For example, the semiconductor apparatus 100 may selectively operate in one of the active modes, a mode for deactivating the output driver thereof in the active state, and an inactive mode. In this example, the mode for deactivating the output driver thereof in the active state may remove the junction capacitance of the output driver 123, and thus the loading of the data output line may be reduced.

Figure 5:
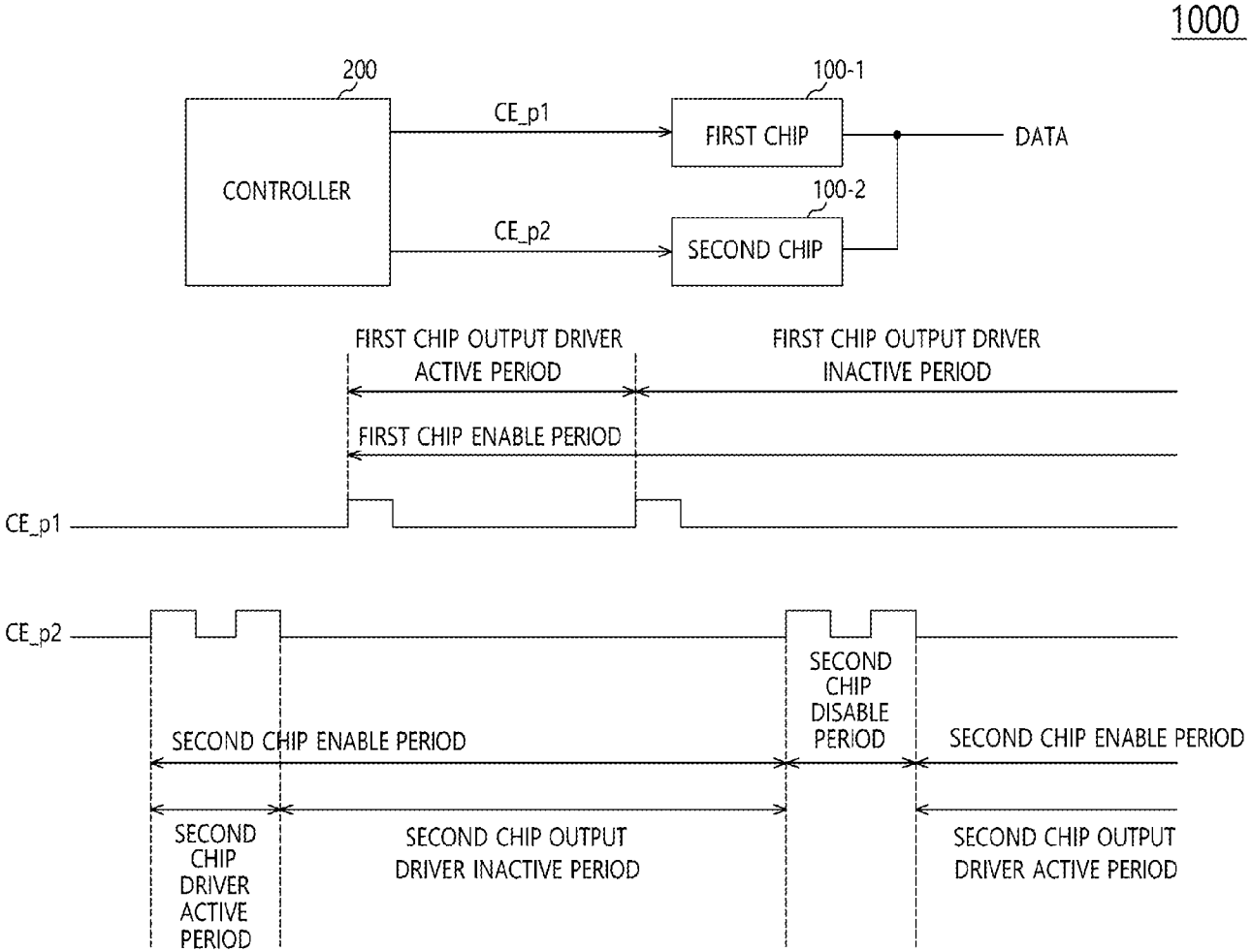
FIG. 5 is a diagram illustrating a configuration and operation timing of a semiconductor system according to an embodiment of the inventive concept.

As illustrated in FIG. 5, a semiconductor system 1000 according to an embodiment may include a controller 200, and first and second chips 100-1 and 100-2.

The first and second chips 100-1 and 100-2 may be different from components of the semiconductor apparatus 100 illustrated in FIGS. 1 to 4 in that input and output signals differ from those of the semiconductor apparatus 100. The first and second chips 100-1 and 100-2, however, may have a substantially similar function and configuration as at least an output driving unit 120 illustrated in the semiconductor apparatus 100.

The controller 200 may provide a first chip enable pulse CE_p1 and a second chip enable pulse CE_p2, in one example, to the first chip 100-1 and the second chip 1002. According to the number of input first chip enable pulses CE_p1 that the controller 200 controls, the first chip 100-1 may be activated or may be switched to a mode for deactivating an output driver thereof in the active state or an inactive mode.

For example, the first chip 100-1 may be activated when the first chip enable pulse CE_p1 is input first, and the output driver of the first chip 100-1 may be activated. When the first chip enable pulse CE_p1 is secondly input, the output driver of the first chip 100-1 may be deactivated in a state that the first chip 100-1 is in the enabled state. When the first chip enable pulse CE_p1 is thirdly input, the first chip 100-1 may be deactivated.

According to the number of input second chip enable pulses CE_p2 that the controller 200 controls, the second chip 100-2 may be activated or may be switched to a mode for deactivating an output driver thereof in the active state or an inactive mode.

For example, the second chip 100-2 may be activated when the second chip enable pulse CE_p2 is input first, and an output driver of the second chip 100-2 may be activated. When the second chip enable pulse CE_p2 is input second, the output driver of the second chip 100-2 may be deactivated in a state that the second chip 100-2 is in the enabled state. When the second chip enable pulse CE_p2 is input third, the second chip 100-2 may be deactivated. There may be a commonly coupled output node of the first chip 100-1 and the second chip 100-2, and data DATA may be output through the commonly coupled output node.

When the input timing of the first and second chip enable pulses CE_p1 and CE_p2 and the input number of first and second chip enable pulses CE_p1 and CE_p2 may be controlled, the output driver of the first chip 100-1 may have an active period during an inactive period of the output driver of the second chip 100-2 as illustrated in the timing diagram of FIG. 5. The output driver of the second chip 100-2 may have an active period during an inactive period of the output driver of the first chip 100-1 as illustrated in the timing diagram of FIG. 5.

As illustrated in FIG. 5, the semiconductor system 1000 including the first and second chips 100-1 and 100-2 that share a node or a line in which the data DATA is output, may deactivate the output driver of one chip of the first and second chips 100-1 and 100-2 which does not output the data DATA, and thus reduce the loading of the data output line. That is, in the inactive output driver, the application of driving voltages is interrupted as illustrated in FIG. 4, and thus the junction capacitance of the data output line, that is, parasitic capacitance, may be reduced. Further, the loading of the data output line may be reduced.

Figure 6:
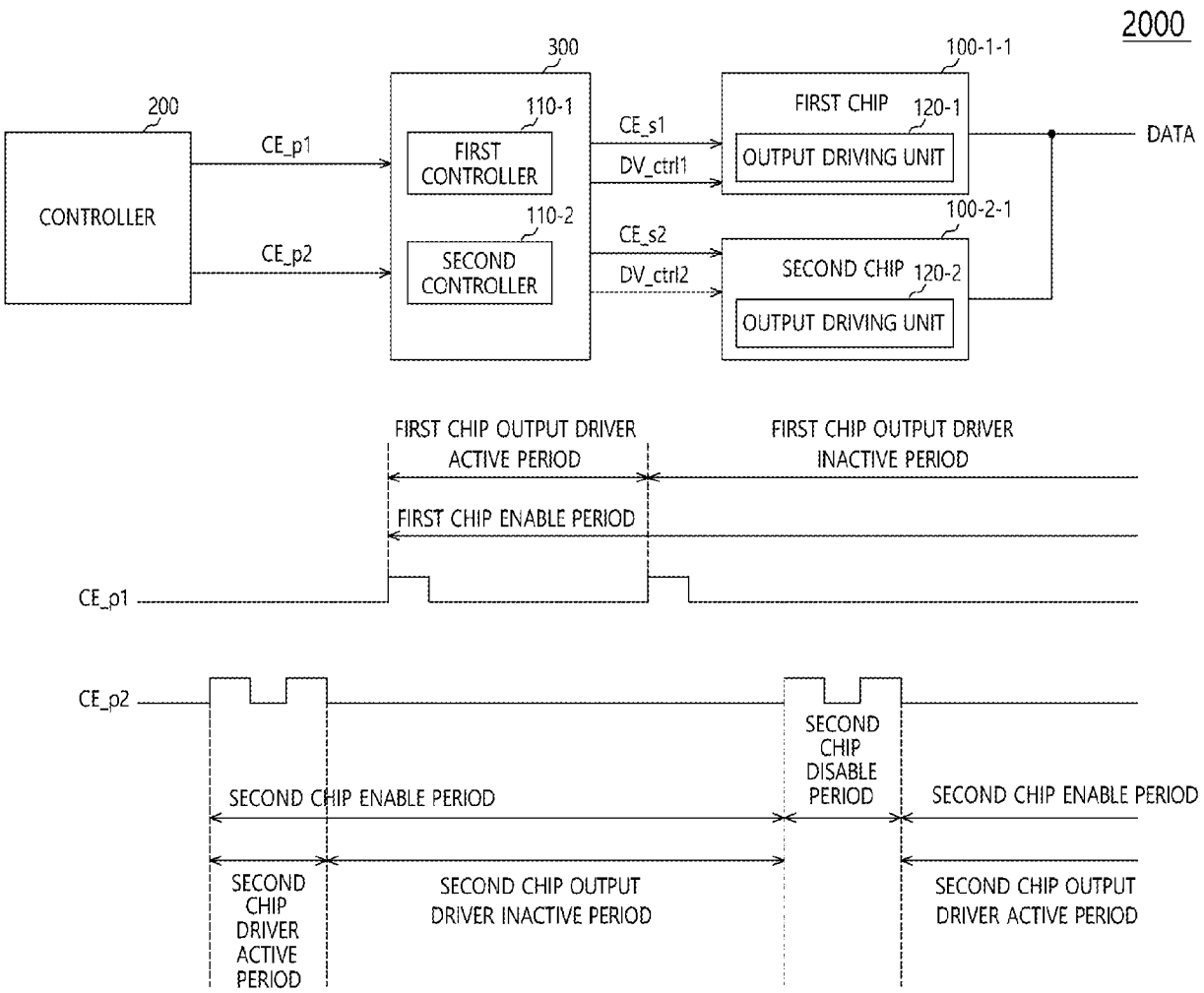
FIG. 6 is a diagram illustrating a configuration and operation timing of a semiconductor system according to an embodiment of the inventive concept.

As illustrated in FIG. 6, a semiconductor system 2000 according to an embodiment may include a controller 200, an interface 300, and first and second chips 100-1-1 and 100-2-1.

The interface 300 may transfer a first chip enable signal CE_s1, a first driving voltage control signal DV_ctrl1, a second chip enable signal CE_s2, and a second driving voltage control signal DV_ctrl2 to the first and second chips 100-1-1 and 100-2-1 in response to first and second chip enable pulses CE_p1 and CE_p2 provided from the controller 200.

The interface 300 may include first and second controllers 110-1 and 110-2.

The first and second controllers 110-1 and 110-2 may be different from the controller 110 illustrated in FIGS. 1 and 2 in that input signals and output signals of the first and second controllers 110-1 and 110-2 are different from those of the controller 100, but the first and second controllers 110-1 and 110-2 may have a same configuration as the controller 110.

For example, the first controller 110-1 may enable and generate the first chip enable signal CE_s1 when the first chip enable pulse CE_p1 is input a first time, enable and generate the first driving voltage control signal DV_ctrl1 when the first chip enable signal CE_s1 is enabled and the first chip enable pulse CE_p1 is input a second time, or disable the first chip enable signal CE_s1 and the first driving voltage control signal DV_ctrl1 when the first chip enable pulse CE_p1 is input a third time.

The second controller 110-2 may enable and generate the second chip enable signal CE_s2 when the second chip enable pulse CE_p2 is input a first time, enable and generate the second driving voltage control signal DV_ctrl2 when the second chip enable signal CE_s2 is enabled and the second chip enable pulse CE_p2 is input a second time, or disable the second chip enable signal CE_s2 and the second driving voltage control signal DV_ctrl2 when the second chip enable pulse CE_p2 is input a third time.

The first chip 100-1-1 may be enabled in response to the first chip enable signal CE_s1. For example, the first chip 100-1-1 may be enabled when the first chip enable signal CE_s1 is enabled and may be disabled when the first chip enable signal CE_s1 is disabled.

The first chip 100-1-1 may include an output driving unit 120-1 having the same configuration as the output driving unit 120 illustrated in FIGS. 1 and 4.

The output driving unit 120-1 included in the first chip 100-1-1 may be activated in response to the first driving voltage control signal DV_ctrl1. For example, the output driving unit 120-1 of the first chip 100-1-1 may be deactivated when the first driving voltage control signal DV_ctrl1 is enabled and may be activated when the first driving voltage control signal DV_ctrl1 is disabled.

The second chip 100-2-1 may be enabled in response to the second chip enable signal CE_s2. For example, the second chip 100-2-1 may be enabled when the second chip 100-2-1 receives an enabled second chip enable signal CE_s2 and may be disabled when the second chip 100-2-1 receives a disabled second chip enable signal CE_s2.

The second chip 100-2-1 may include an output driving unit 120-2 having the same configuration as the output driving unit 120 illustrated in FIGS. 1 and 4.

The output driving unit 120-2 included in the second chip 100-2-1 may be activated in response to the second driving voltage control signal DV_ctrl2. For example, the output driving unit 120-2 of the second chip 100-2-1 may be deactivated when the second driving voltage control signal DV_ctrl2 is enabled and may be activated when the second driving voltage control signal DV_ctrl2 is disabled.

According to the number of first chip enable pulses CE_p1 input, the first chip 100-1-1 may be activated or may be deactivated, or an output driver of the first chip 100-1-1 may be placed in an activated state or a deactivated mode. For example, when the first chip enable pulse CE_p1 is input first, the first chip 100-1-1 may be enabled and the output driving unit 120-1 of the first chip 100-1-1 may be activated. When the first chip enable pulse CE_p1 is input a second time, the output driving unit 120-1 of the first chip 100-1-1 may be deactivated while the first chip 100-1-1 is enabled. When the first chip enable pulse CE_p1 is input a third time, the first chip 100-1-1 may be deactivated.

According to the number of input second chip enable pulses CE_p2, the second chip 100-2-1 may be activated or may deactivated, or an output driver of the second chip 100-2-1 may be placed in the activated state or an inactive mode. For example, when the second chip enable pulse CE_p2 is input first, the second chip 100-2-1 may be enabled and the output driving unit 120-2 of the second chip 100-2-1 may be activated. When the second chip enable pulse CE_p2 is input a second time, the output driving unit 120-2 of the second chip 100-2-1 may be deactivated while the second chip 100-2-1 is enabled. When the second chip enable pulse CE_p2 is input a third time, the second chip 100-2-1 may be deactivated. There may be a commonly coupled output node of the first chip 100-1-1 and the second chip 100-2-1, and data DATA may be output through the commonly coupled output node.

When the input timings of the first and second chip enable pulses CE_p1 and CE_p2 and the input number of first and second chip enable pulses CE_p1 and CE_p2 are controlled, the output driver of the first chip 100-1-1 may have an active period during an inactive period of the output driver of the second chip 100-2-1 as illustrated in the timing diagram of FIG. 6. The output driver of the second chip 100-2-1 may have an active period during an inactive period of the output driver of the first chip 100-1-1 as illustrated in the timing diagram of FIG. 6. Thus, the controller 200 may provide the first and second chip enable pulses CE_p1 and CE_p2 for non-overlapping active periods between the first and second output driving units 120-1 and 120-2.

As illustrated in FIG. 6, the semiconductor system 2000 including the first and second chips 100-1-1 and 100-2-1 that share a node or a line in which the data DATA is output, may deactivate the output driver of one chip of the first and second chips 100-1-1 and 100-2-1 which does not output the data, and thus reduce a loading of the data output line. That is, in the inactive output driver, the application of driving voltages is interrupted as illustrated in FIG. 4, and thus the junction capacitance of the data output line, that is, parasitic capacitance, may be reduced. Because junction capacitance of the data output line may be reduced, loading may be reduced.

The above embodiment of the present disclosure is illustrative and not limitative. Various alternatives and equivalents are possible. The disclosure is not limited by the embodiment described herein. Nor is the disclosure limited to any specific type of semiconductor device. Other additions, subtractions, or modifications are obvious in view of the present disclosure and are intended to fall within the scope of the appended claims.

What is claimed is:

1. A semiconductor apparatus comprising:

a controller configured to generate a plurality of control signals for selecting an operation mode of the semiconductor apparatus in response to a number of input chip enable pulses; and an output driving unit configured to operate according to the operation mode of the semiconductor apparatus based on the plurality of control signals, wherein the plurality of control signals include a driving voltage control signal and a chip enable signal.

2. The semiconductor apparatus of claim 1, wherein the controller is configured to generate the driving voltage control signal and the chip enable signal in response to the number of input chip enable pulses.

3. The semiconductor apparatus of claim 2, wherein when the chip enable pulse is input, the controller is configured to enable the chip enable signal in a state that the driving voltage control signal is disabled, enable the driving voltage control signal in a state that the chip enable signal is enabled, or disable both the chip enable signal and the driving voltage control signal.

4. The semiconductor apparatus of claim 3, wherein the controller includes:

a chip enable pulse input unit configured to generate a first chip enable determination signal, a second chip enable determination signal, and the driving voltage control signal in response to the number of input chip enable pulses; and a chip enable signal generator configured to generate the chip enable signal in response to the first and second chip enable determination signals.

5. The semiconductor apparatus of claim 4, wherein the chip enable pulse input unit is configured to sequentially enable one of the first and second chip enable determination signals and the driving voltage control signal whenever the chip enable pulse is input.

6. The semiconductor apparatus of claim 5, wherein:

the chip enable signal generator is configured to disable the chip enable signal in a period in which the first chip enable determination signal is enabled and the second chip enable determination signal is disabled; and the chip enable signal generator is configured to enable the chip enable signal in a remaining period other than a period in which the first chip enable determination signal is enabled and the second chip enable determination signal is disabled.

7. The semiconductor apparatus of claim 1, wherein the output driving unit is configured to be operated according to one of a mode in which the output driving unit is activated in a state that the semiconductor apparatus is enabled and which outputs data in response to pull up data and pull down data, a mode in which the output driving unit is deactivated in a state that the semiconductor apparatus is enabled, and a mode in which the semiconductor apparatus is deactivated.

8. The semiconductor apparatus of claim 7, wherein the output driving unit is configured to be activated or deactivated in response to the driving voltage control signal, and to output the data in response to the pull up data and the pull down data in an activated state.

9. The semiconductor apparatus of claim 8, wherein the output driving unit includes:

a first driving voltage application unit configured to output a first driving voltage in response to the driving voltage control signal;

a second driving voltage application unit configured to output a second driving voltage in response to the driving voltage control signal; and an output driver configured to generate the data in response to the pull up data and the pull down data by receiving the first and second driving voltages.

10. The semiconductor apparatus of claim 9, wherein each of the first and second driving voltage application units is configured to provide the first and second driving voltages to the output driver when the driving voltage control signal is disabled, and to stop providing of the first and second driving voltages to the output driver when the driving voltage control signal is enabled.

11. The semiconductor apparatus of claim 10, wherein the output driver is configured to output the data in response to the pull up data and the pull down data when the first and second driving voltages are provided, and reduce parasitic capacitance in a line or a node to which the data is output when the first and second driving voltages are not provided.

12. A semiconductor system comprising:

a controller configured to provide a first chip enable pulse and a second chip enable pulse;

a first chip configured to select an operation mode thereof in response to a number of input first chip enable pulses; and a second chip configured to select an operation mode in response to another number of input second chip enable pulses, wherein an output node of the first chip and an output node of the second chip, to which data is output, are commonly coupled.

13. The semiconductor system of claim 12, wherein when the first chip enable signal is input, the first chip is activated and activates a first output driver thereof, deactivates the first output driver in the active state thereof, or is deactivated.

14. The semiconductor system of claim 13, wherein when the second chip enable signal is input, the second chip is activated and activates a second output driver thereof, deactivates the second output driver in the active state thereof, or is deactivated.

15. The semiconductor system of claim 14, wherein the controller is configured to control a number of input first and second enable pulses so that when one of the first and second output drivers is activated, the other is deactivated.

16. A semiconductor system comprising:

a first chip configured with respect to a first chip enable signal and a first driving voltage control signal, and the first chip includes a first output driving unit;

a second chip configured with respect to a second chip enable signal and a second driving voltage control signal, and the second chip includes a second output driving unit;

an interface including a first controller configured to generate the first chip enable signal and the first driving voltage control signal in response to a number of input first chip enable pulses and the interface includes a second controller configured to generate the second chip enable signal and the second driving voltage control signal in response to a number of input second chip enable pulses; and a controller configured to provide the first and second chip enable pulses.

17. The semiconductor system of claim 16, wherein the controller is configured to provide the first and second chip enable pulses for non-overlapping active periods between the first and second output driving units.

18. The semiconductor system of claim 17, wherein the first controller is configured to enable the first chip enable signal, enable the first driving voltage control signal in a state that the first chip enable signal is enabled, or disable both the first chip enable signal and the first driving voltage control signal, according to the number of input first chip enable pulses, and the second controller is configured to enable the second chip enable signal, enable the second driving voltage control signal in a state that the second chip enable signal is enabled, or disable both the second chip enable signal and the second driving voltage control signal, according to the number of input second chip enable pulses.

* * * * *